US008916776B2

(12) United States Patent
Cinquemani et al.

(10) Patent No.: US 8,916,776 B2
(45) Date of Patent: Dec. 23, 2014

(54) CABLE HAVING EXPANDED, STRIPPABLE JACKET

(75) Inventors: Paul Cinquemani, Lexington, SC (US); Andrew Maunder, Columbia, SC (US); Paolo Veggetti, Milan (IT); Alberto Bareggi, Milan (IT); Sergio Belli, Milan (IT)

(73) Assignee: Prysmian Cavi E Sistemi Energia S.R.L., Milan (IT)

( * ) Notice: Subject to any disclaimer, the term of this patent is extended or adjusted under 35 U.S.C. 154(b) by 1370 days.

(21) Appl. No.: 11/988,740

(22) PCT Filed: Jul. 15, 2005

(86) PCT No.: PCT/US2005/025328

§ 371 (c)(1),
(2), (4) Date: Apr. 3, 2009

(87) PCT Pub. No.: WO2007/011350

PCT Pub. Date: Jan. 25, 2007

(65) Prior Publication Data

US 2009/0200059 A1 Aug. 13, 2009

(51) Int. Cl.

| | |
|---|---|
| ***H01B 7/295*** | (2006.01) |
| ***H01B 9/02*** | (2006.01) |
| ***H01B 7/18*** | (2006.01) |

(52) U.S. Cl.

CPC ..... *H01B 7/189* (2013.01); *H01B 9/025* (2013.01); *H01B 7/185* (2013.01)

USPC ..... 174/120 R; 174/120 SC

(58) Field of Classification Search

USPC ..... 174/107, 120 R, 120 SC

See application file for complete search history.

(56) References Cited

U.S. PATENT DOCUMENTS

| | | | | |
|---|---|---|---|---|
| 3,013,109 | A | 12/1961 | Gorman et al. | |
| 3,936,591 | A | 2/1976 | Smith et al. | |
| 4,256,921 | A * | 3/1981 | Bahder | 174/107 |
| 4,360,704 | A * | 11/1982 | Madry | 174/36 |
| 4,789,589 | A | 12/1988 | Baxter | |
| 4,965,412 | A * | 10/1990 | Lai et al. | 174/107 |

(Continued)

FOREIGN PATENT DOCUMENTS

| | | | |
|---|---|---|---|
| GB | 1 300 047 | | 12/1972 |
| WO | WO-02/45100 | A1 | 6/2002 |
| WO | WO-03/088274 | A1 | 10/2003 |
| WO | WO-2004/053896 | A1 | 6/2004 |

OTHER PUBLICATIONS

"Standard for Concentric Neutral Cables Rated 5 Through 46 KV"; Publication ICEA S-94-649-2004, Insulated Cable Engineers Association, Inc., pp. i-ix, and 1-103, (Oct. 14, 2004).

*Primary Examiner* — Chau N Nguyen

(74) *Attorney, Agent, or Firm* — Finnegan, Henderson, Farabow, Garrett & Dunner, L.L.P.

(57) ABSTRACT

An electric power cable contains a core and a jacket forming the exterior of the cable. The jacket is formed by extruding a first layer and a second layer over a plurality of concentric neutral elements, substantially encapsulating these elements. At least the first layer is an expanded polymeric material, by having its density reduced through the use of a foaming agent during extrusion. The second layer, which may also be expanded, is extruded around the first layer. The expanded polymeric material makes stripping the jacket easier, minimizes indentations in the cable's insulation layers, lightens the cable, and increases the cable's flexibility.

23 Claims, 5 Drawing Sheets

(56) References Cited

U.S. PATENT DOCUMENTS

| | | | | |
|---|---|---|---|---|
| 4,986,372 | A | 1/1991 | Ganssle | |
| 5,010,209 | A | 4/1991 | Marciano-Agostinelli et al. | |
| 5,210,377 | A * | 5/1993 | Kennedy et al. | 174/107 |
| 5,807,447 | A * | 9/1998 | Forrest | 156/51 |
| 5,841,072 | A | 11/1998 | Gagnon | |
| 6,064,007 | A * | 5/2000 | Bernstein et al. | 174/110 R |
| 6,501,027 | B1 | 12/2002 | Belli et al. | |
| 7,166,802 | B2 | 1/2007 | Cusson et al. | |
| 2003/0079903 | A1 | 5/2003 | Scheidecker et al. | |
| 2004/0065456 | A1 * | 4/2004 | Belli et al. | 174/25 R |

* cited by examiner

CABLE HAVING EXPANDED, STRIPPABLE JACKET

TECHNICAL FIELD

The present invention relates generally to power cables having polymeric outer jackets. More specifically, the present invention relates to power cables having concentric neutral elements embedded in their outer jackets or sheaths.

BACKGROUND

Electrical power cables typically have an outer jacket, or sheath, that surrounds the exterior of the cable and provides thermal, mechanical, and environmental protection for the conductive elements within. Outer jackets often comprise polyethylene, polyvinylchloride, or nylon.

Cables designed for medium voltage distribution (generally 5 kV through 46 kV), such as feeder cables or those designed for residential or primary underground distribution, generally have a non-expanded polymeric jacket formed in a single layer. These cables may also include elements, wires or flat straps, for example, formed within the jacket and arranged concentrically around the cable's axis and helically along its length. These elements, also called "concentric neutrals" or "wire serves," provide a return current path to accommodate faults. The elements typically need to have the capacity to carry high electrical currents (thousands of amperes) for a short duration (60 cycles/second or less) during an emergency condition until a relay system can interrupt the distribution system.

FIG. 1 is a traverse cross-sectional diagram of a conventional concentric neutral element cable. The cable 100 contains a conductor 110, a semi-conducting conductor shield 115, an insulation layer 120, an insulation shield 125, an outer jacket 130, and concentric neutral elements 150. The concentric neutral elements 150 serve as a neutral return current path and must be sized accordingly. The insulation shield 125 is usually made of an extruded semiconducting layer that surrounds the insulation layer 120. The conductor 110 serves to distribute electrical power along the cable 100.

Jackets for concentric neutral cables are typically extruded under pressure during cable manufacture. This process, known as "extruded to fill," leads to an encapsulated thermoplastic polymer layer surrounding the cable. Pressure extrusion causes the polymeric material to fill the interstitial areas between and around the neutral elements. Further, the materials typically selected for such processing, such as a polyethylene, have a tendency to shrink-down after extrusion and thus maintain a firm hold over the cable core. Additionally, the use of extruded-to-fill polymeric jackets are commonly employed to provide good hoop-stress protection, to lock-in the concentric neutrals, withstand reasonable temperatures during fault situations, and to provide good mechanical protection. Indeed, jackets in underground residential distribution must be robust enough to handle the mechanical rigors of installation via direct burial trenches or plow-in.

While extruded-to-fill outer jackets provide certain advantages as noted above, such outer jacket construction creates a number of issues as well. For example, a significant degree of physical force is required to remove the outer jacket from the core, increasing the likelihood of damaging the core. Indeed, in removing the jacket in the field, it is common practice for utility linemen to retrieve one of the heavy concentric neutral elements under the jacket and use it as a ripcord to pull through the jacket. The wire is lifted and pulled at an approximate 150 angle to the axis of the cable, cutting the jacket along the spiral axis of the neutral element. The force required to pull the element can be significant.

The high degree of physical force to remove the jacket arises for a number of reasons. First, due to the affinity of polyethylene class of jackets to the class of materials normally employed as semi-conducting insulation shields, there is a tendency for the two materials to stick together or form a light to moderate bond. To overcome this bonding, cable manufacturers often apply, for example, talc/mica to allow easy separation of the two layers. Water-swellable powder may also be applied as described in U.S. Pat. No. 5,010,209. The use of these powders decreases the likelihood of water migration between jacket- and insulation shield interface, in the event water enters due to a breach in the outer jacket. Second, a high degree of force in stripping or removing the jacket arises because, in encapsulating the concentric neutral elements, the jacket is often thicker than jackets in comparable cables without concentric neutrals. More than 90% of concentric neutral cables for underground residential distribution have neutral elements that range between #14 AWG (64.1 mils or 1.29 mm in diameter) to #8 AWG (128.5 mils or 3.26 mm in diameter). Industry standards often specify the minimum thickness for the jacket in such cables to be determined according to the thickness over these concentric neutral elements, resulting in a larger and more rugged jacket.

The increased size of jackets in concentric neutral cables may also cause those cables to be less flexible. Although a cable designer can specify alternate types of insulation to improve flexibility without sacrificing reliability, the overall encapsulated jacket maintains significant influence over the flexibility of such cables. Alternate jacket materials that improve flexibility are available; those materials may be undesirable because they do not satisfy more significant attributes in the cable design.

In addition, a concern in the industry exists with undesirable indentations in the insulation shield that can arise in concentric neutral cables having extruded-to-fill jackets. These indentations occur as the rigid, conventional jackets shrink down after extrusion and force the neutral elements into the shield. The indentations may increase after applying the cable to a shipping reel where the weight of the cable on the inner wraps of the reel may further induce compression. The indentations in the insulation shield take the helical path of the neutral elements. Should water enter the cable due to a breach in the jacket, the helical indentations can provide conduits or channels for the water to migrate longitudinally along the cable. At times, the indentations may transfer through the insulation shield and leave indentations to a lesser extent on the surface of the insulation.

Despite these issues, jackets for concentric neutral cables tend to be a single, encapsulated layer of polyethylene-class material to ensure that the cable can withstand the mechanical rigors of underground installation. For other types of cables, however, jackets incorporating an inner layer of expanded polymer material have been disclosed in the art to help protect cables against accidental impacts. Expanded polymeric materials are polymers that have a reduced density because gas has been introduced to the polymer while in a plasticized or molten state. This gas, which can be introduced chemically or physically, produces bubbles within the material, resulting in voids. A material containing these voids generally exhibits such desirable properties as reduced weight and the ability to provide more uniform cushioning than a material without the voids. The addition of a large amount of gas results in a much lighter material, but the addition of too much gas can decrease some of the resiliency of the material.

U.S. Pat. No. 6,501,027, for example, describes a coating layer preferably in contact with the cable sheath for providing impact resistance for the cable. The coating layer is made from an expanded polymer material (i.e., a polymer that has a percentage of its volume not occupied by the polymer but by a gas or air) having a degree of expansion of from about 20% to 3000%.

Applicants have observed that expanded polymeric materials are potential candidates for improving the structure and performance of cables having embedded elements in their jackets, such as concentric neutral power cables. Applicants have further observed that unlike conventional designs for concentric neutral cables, cables having multiple layer jackets including a layer of expanded polymeric material may result in a jacket that is easier to strip, has increased flexibility, and decreased incidence of indentations in the insulation.

SUMMARY

In accordance with the principles of the invention, a cable includes a core and a jacket surrounding the core and forming the exterior of the cable. A first portion of the jacket substantially encapsulates a plurality of neutral elements arranged circumferentially around a radius and helically along the length of the cable. At least the first portion of the jacket is an expanded polymeric material. The jacket of the cable may be at least one material selected from the group consisting of polyvinyl chlorides (PVC), ethylene vinyl acetates (EVA), low density polyethylene, LLDPE, HDPE, polypropylene, and chlorinated polyethylene.

The core has a conductor, a conductor shield surrounding the conductor, an insulation surrounding the conductor shield, and an insulation shield surrounding the insulation. The insulation shield is a semi-conducting material and the neutral elements electrically contact the semi-conducting insulation shield. Preferably, the neutral elements are wires ranging in size from #24 AWG to #8 AWG. Also, the total circular mil area of the plurality of the neutral elements may be between about 5000 circular mils per inch of insulated core diameter to the full total circular mil area of the phase conductor.

The jacket may include an inner circumferential layer proximate to the core and including the first portion, and an outer circumferential layer forming the exterior of the cable. The outer circumferential layer need not be an expanded polymeric material. At least one of the inner and outer layers may have a degree of expansion of about 2-50%.

In one cable design, the outer layer comprises about 20-30% of a radial thickness of the jacket, the inner and outer layers comprise linear low density polyethylene (LLDPE), and the inner layer has a degree of expansion of up to about 15-25%. In another design, the outer layer comprises high density polyethylene (HDPE) and comprises about 20% of a radial thickness of the jacket, and the inner layer is LLDPE and has a degree of expansion of up to about 30%.

Typically, at least one of the first and second layers of the outer jacket are expanded within a range of about 2% to 50%. This construction results in a cable that has an impact resistance improvement of about 5% to 15% and increased flexibility of about 5% to 25% over conventional cable designs. Further, such a construction will result in an outer jacket with a stripping force reduction of about 10% to 30% and the concentric neutral wire serve indent is reduced by at least 10% when compared to conventional cable designs. A third layer may be expanded within a range of about 10% to 12% provide even further protection for the cable.

A method of making a cable in accordance with the principles of the invention first comprises providing a conductor and applying a shield around the conductor. Next, insulation is extruded over the shield and an insulation shield is applied over the insulation. Next, concentric neutral elements are applied around the insulation shield. From here, a polymeric material is expanded with a foaming agent. This polymeric material is then used to form the first layer of an outer jacket by extruding the first layer of expanded polymeric material and a second exterior layer to substantially encapsulate the concentric neutral elements.

It is to be understood that both the foregoing general description and the following detailed description are exemplary and explanatory only, and are not restrictive of the invention as claimed.

BRIEF DESCRIPTION OF THE DRAWINGS

The accompanying drawings, which are incorporated in and constitute a part of this specification, illustrate several embodiments of the invention, and together with the description, serve to explain the principles of the invention.

DETAILED DESCRIPTION

Reference will now be made in detail to embodiments in accordance with the present invention, examples of which are illustrated in the accompanying drawings. Wherever possible, the same reference numbers will be used throughout the drawings to refer to the same or like parts.

Consistent with the principles of the present invention, a cable comprises a core and a jacket, or outer sheath, surrounding the core and forming an exterior of the cable. The core may comprise a conductor, a conductor shield, insulation, and an insulation shield. The jacket preferably has two concentric layers. The layers are formed by co-extruding them over a plurality of concentric neutral elements, which causes a portion of the inner layer to substantially encapsulate the neutral elements. By "substantially encapsulates," it is meant that the extruded material surrounds most, if not all, of the exterior of the concentric neutral elements. At least the portion of the inner layer that substantially encapsulates the neutral elements comprises an expanded polymeric material.

Figure 1:
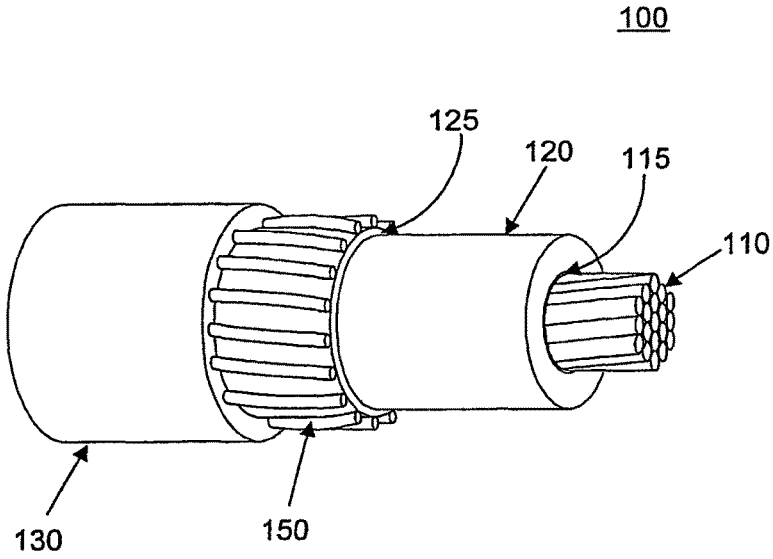
Prior Art FIG. 1
FIG. 1 is a traverse cross-sectional diagram of a conventional cable.
Figure 2:
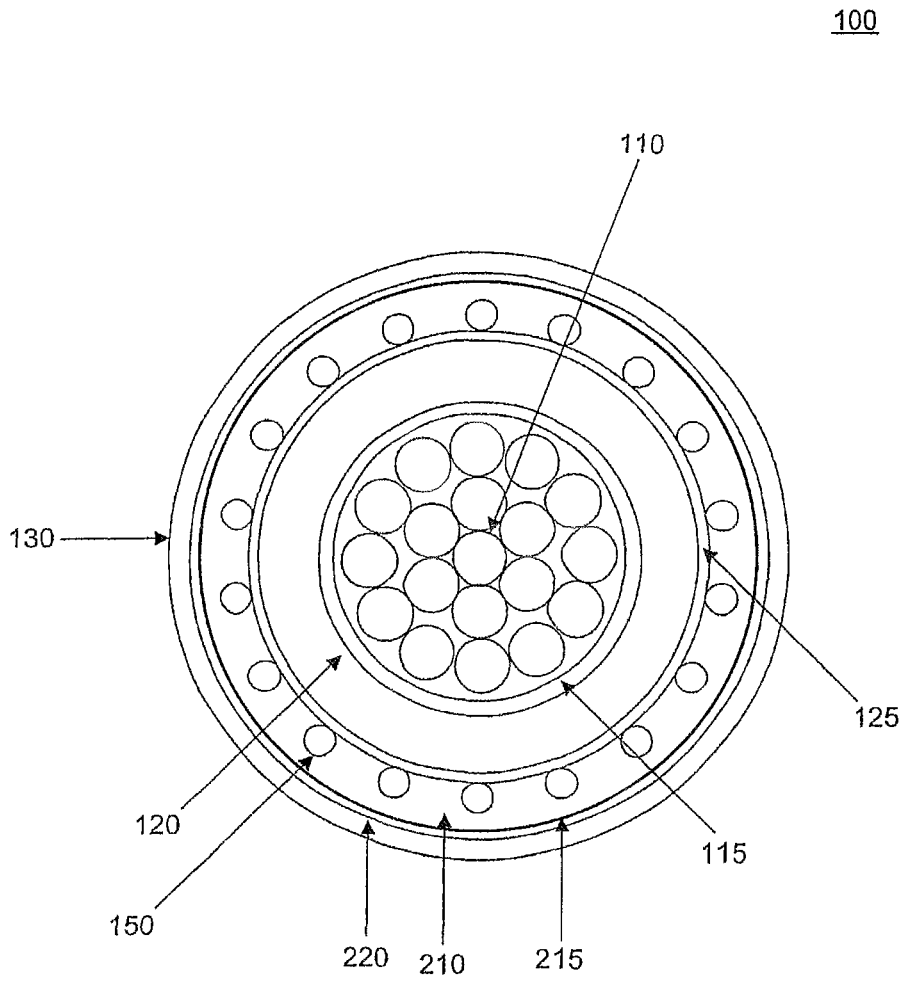
FIG. 2 is a transverse cross-sectional diagram of a cable consistent with the principles of the present invention.
Figure 3:
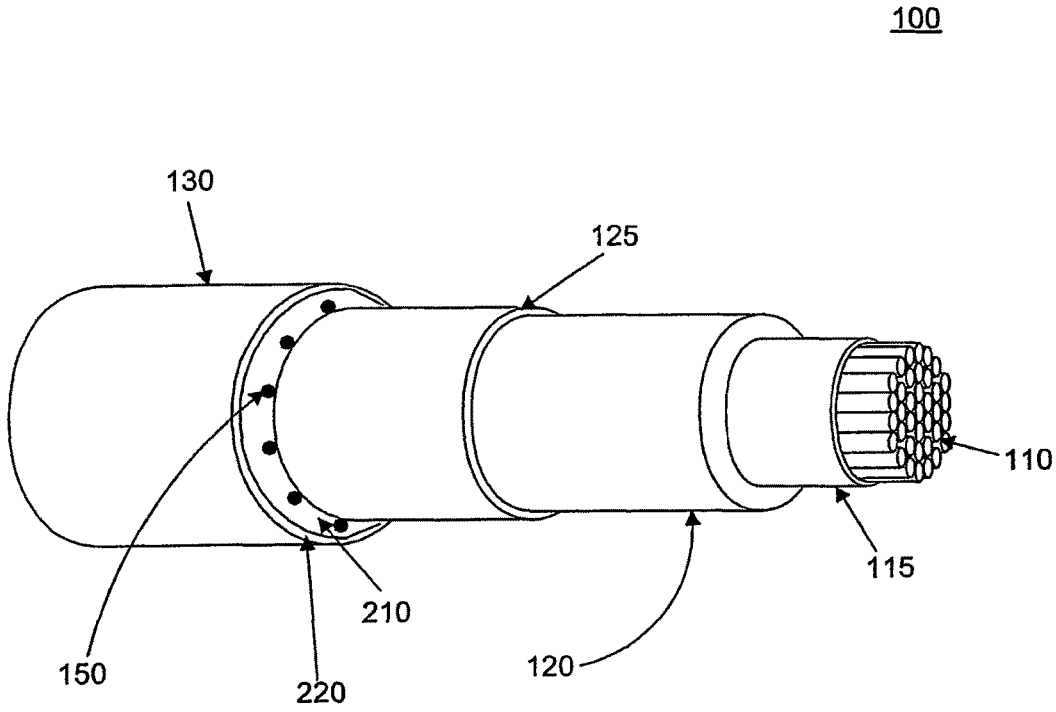
FIG. 3 is a longitudinal perspective diagram of the cable of FIG. 2.

As embodied herein, a cable consistent with the principles of the present invention is depicted in FIGS. 2 and 3. FIG. 3 is a longitudinal perspective diagram of the cable 100 of FIG. 2. Cable 100 includes a core-having a conducting element 110. Conductors 110 are normally either solid or stranded, and are made of copper, aluminum or aluminum alloy. Stranding the conductor adds flexibility to the cable construction. One of ordinary skill would recognize that the conducting element 110 may comprise mixed power/telecommunications cables, which include an optical fiber core in addition to or in place of electrical cables. Therefore, the term "conductive element" means a conductor of the metal type or of the mixed electrical/optical type.

The core also includes a conductor shield 115 that surrounds the conducting element 110. Conductor shield 115 is generally made of a semiconducting material and is used for electrical stress control.

Insulation layer 120 surrounds conductor shield 115. Insulation 120 is an extruded layer that provides electrical insulation between conductor 110 and the closest electrical ground, thus preventing an electrical fault. One of ordinary skill in the art would recognize that the insulation layer 120 may comprise a cross-linked or non-cross-linked polymeric composition with electrical insulating properties known in the art. Examples of such insulation compositions for low and medium voltage cables are: crosslinked polyethylene, ethylene propylene rubber, polyvinyl chloride, polyethylene, ethylene copolymers, ethylene vinyl acetates, synthetic and natural rubbers.

A semi-conducting insulation shield 125 is provided about insulation 120. The insulation shield 125 is usually made of an extruded semiconducting layer that is strippable, partially bonded or fully bonded to insulation layer 120. Insulation shield 125 and conductor shield 115 are used for electrical stress control providing for more symmetry of the dielectric fields within cable 100.

A plurality of electrically conductive strands 150, or concentric neutral elements, are located exterior to insulation shield 125. The concentric neutrals 150 serve as a neutral return current path in the case of fault conditions and must be sized accordingly. The elements 150 are preferably arranged concentrically around the axis of cable 100 and are twisted helically along its length. Neutral elements 150 are typically copper wires. Although most conventional concentric-neutral cables have neutral wires ranging in size from #14 AWG to #8 AWG, neutral elements 150 may have any practical size, such as from #24 AWG to #8 AWG. Alternatively, they may range in size collectively from about 5000 circular mils per inch of insulated core diameter to the full size of conductor 110. They also may be configured as flat straps or other non-circular shapes as the implementation permits.

Outer jacket 130 surrounds semi-conducting insulator 125 and forms the exterior of cable 100. Outer jacket 130 comprises a polymeric material and may be formed through pressure extrusion, as described in more detail below. Outer jacket 130 serves to protect the cable from environmental, thermal, and mechanical hazards and substantially encapsulates concentric neutral elements 150. When extruded, outer jacket 130 flows over semi-conducting insulating layer 125 and surrounds neutral elements 150. The thickness of outer jacket 130 results in an encapsulated sheath that stabilizes neutral elements 150, maintains uniform neutral spacing for current distribution, and provides a rugged exterior for cable 100. While the polymeric material of the jacket flows around elements 150, the elements typically maintain a sufficient electrical contact with shield 125, such that the jacket may not entirely surround elements 150.

Outer jacket 130 comprises an expanded polymeric material, which is produced by expanding (also known as foaming) a known polymeric material to achieve a desired density reduction. The expanded polymeric material of the jacket can be selected from the group comprising: polyolefins, copolymers of different olefins, unsaturated olefin/ester copolymers, polyesters, polycarbonates, polysulphones, phenolic resins, ureic resins, and mixtures thereof. Examples of preferred polymers are: polyvinyl chlorides (PVC), ethylene vinyl acetates (EVA), polyethylene (categorized as low density, linear low density, medium density and high density), polypropylene, and chlorinated polyethylenes.

The selected polymer is usually expanded during the extrusion phase. This expansion may either take place chemically by means of blending the polymeric material with a chemical foaming agent. This blend is also referred to as a foaming masterbatch and is capable of generating a gas under defined temperature and pressure conditions, or may take place physically (i.e., by means of injection of gas at high pressure directly into an extrusion cylinder). When a polymeric material is expanded using a foaming chemical agent, small pockets, or voids, are created where gas from the expansion process is trapped within the expanded polymeric material. The surface area of the expanded polymeric material that surrounds a void is commonly referred to as a foamed cell.

Examples of suitable chemical expanders are azodicarbonamide, mixtures of organic acids (for example citric acid) with carbonates and/or bicarbonates (for example sodium bicarbonate). Examples of gases to be injected at high pressure into the extrusion cylinder are nitrogen, carbon dioxide, air and low-boiling hydrocarbons such as propane and butane.

The foaming masterbatch may include either an endothermic, exothermic, or hybrid chemical foaming agent ("CFA"). CFAs react with the heat from the process or another chemical to liberate gas. CFAs are typically divided into two classes, endothermic and exothermic. Endothermic CFAs absorb heat during their chemical reaction and yield carbon dioxide gas, lower pressure gas, and small cells. Exothermic CFAs release heat and yield nitrogen, higher pressure gas, higher gas yield and larger cells. Hybrid CFAs, a family of CFAs containing mixtures of endothermic and exothermic foaming agents, combine the fine, uniform cell structure of endothermics with higher gas pressure from the exothermic component.

The choice of an endothermic, exothermic, or hybrid chemical foaming agent depends upon the compatibility with the polymeric material incorporated into the expanded jacket layer, extrusion profiles and processes, the desired amount of foaming, foamed cell size and structure, as well as other design considerations particular to the cable being produced and apparent to those skilled in the art. In general, given similar amounts of active ingredient, exothermic chemical foaming agents will reduce density the most and produce a foam with more uniform and larger foamed cells. Endothermic foaming agents produce foams with a finer foamed cell structure. This is due, at least in part, of the endothermic foaming agent releasing less gas and having a better nucleation controlled rate of gas releases than an exothermic foaming agent. While an exothermic foaming layer is employed in a preferred embodiment, other foaming agents can result in satisfactory cell structures. A closed-cell structure is preferred so as to not provide channels for water migration, and to provide good mechanical strength and a uniform surface texture of the expanded jacket.

The expanded polymeric materials of jacket 130 include voids or spaces occupied by gas or air. In general, the percentage of voids in an expanded polymer (i.e. the ratio of the volume of the voids per a given volume of polymeric material) is expressed by the so-called "degree of expansion" (G), defined as:

$$G=(d_0/d_e-1)\times 100$$

where $d_0$ indicates the density of the unexpanded polymer and $d_e$ represents the measured apparent density, or weight per unit volume in g/cm$^3$, of the expanded polymer. It is desirable to obtain as great a degree of expansion as possible while still achieving the desired cable properties. In particular, a higher degree of expansion will result in reduced material costs by increasing the space occupied by voids in outer jacket 130. In addition, by having more space occupied by voids, outer jacket 130 is more capable of absorbing forces applied externally to the cable 100. Further, because cable 100 has improved impact resistance, the concentric neutral elements 150 are less likely to create an indentation on the surface of semi-conducting insulation shield 125 and/or the insulation 120. Applicants have found that suitable degrees of expansion, or reduction in density, are generally in the range of about 2% to 50%, although higher degrees of expansion may be obtained.

As noted above, foaming can provide a reliable degree of expansion. The selected CFA should be capable of achieving consistent cable dimensions of the inner circumferential layer 210 and additionally uniform surface conditions when employed in the outer circumferential layer 220. A CFA that has been found to be particularly successful in the preferred embodiment is Clariant Hydrocerol B1H 40, marketed by Clariant of Winchester, Va.

Several elements are known to affect foaming consistency: 1) the addition rate of the foaming masterbatch; 2) the shape of foamed cell structure achieved within the polymeric wall; 3) the extrusion speed (meters/minute); and 4) the cooling trough water temperature. A cooling trough is typically positioned to receive the cable, within about two to five feet, as it exits the extruder and is about 100 to 250 feet in length. The cooling trough can be sectioned to control water temperatures in multiple sections and is used to gradually cool the temperature of the cable, and thus, reduce the amount of shrinkage in the extruded jacket. Those of ordinary skill in the art can determine the parameters for producing jacket 130, having consistent, and desired, performance properties.

As illustrated in FIGS. 2 and 3, outer jacket 130 may comprise an inner circumferential layer 210 and an outer circumferential layer 220. Inner circumferential layer 210 is arranged circumferentially around the cable and is proximate to insulation shield 125. As such, at least a first portion of the inner circumferential layer 210 substantially encapsulates neutral elements 150. Outer circumferential layer 220 surrounds the cable and serves as its exterior.

In accordance with the principles of the present invention, inner circumferential layer 210, outer circumferential layer 220, or both may be expanded polymers. In a preferred embodiment, inner layer 210 of jacket 130 is made of expanded (density reduced) linear low density polyethylene (LLDPE) via the addition of foaming agents, while the second or outer circumferential layer 220 of the overall sheath consists of a solid skin layer of LLDPE that is not expanded. The materials selected for such a composite jacket must have good affinity in order to ensure the composite jacket results in preferably a single bonded structure.

Applicants have found that the amount of density reduction in the inner layer for achieving good eccentricity of the overall jacket and meeting required properties of the jacket material may depend on the wall thickness of the jacket layers. For example, a jacket with a heavier non-expanded outer circumferential layer 220 will permit a greater degree of density reduction of inner circumferential layer 210 and be able to maintain excellent eccentricity and low irregularities on the surface of the overall jacket. Experimentation has found that with composite LLDPE materials, an outer circumferential layer 220 that is 20% of the total thickness of jacket 130 allows inner circumferential layer 210 to be expanded about 15%. Whereas an outer circumferential layer 220 that is 30% of the total thickness of outer jacket 130 allows inner circumferential layer 210 to be expanded about 25% and achieve the desired overall physical and dimensional properties with no surface irregularities.

A higher amount of density reduction for inner circumferential layer 210 is possible when a higher density polymer is used in outer circumferential layer 220. Specifically, in the case where the outer layer of the jacket is high density polyethylene (HDPE) and the inner layer is LLDPE, an outer circumferential layer 220 that is about 20% of the total jacket thickness will permit a density reduction for inner circumferential layer 210 to reach about 30% due to the greater higher physical properties of the HDPE. Hence, the ultimate overall sheath design characteristics are synergistically affected by the combination of types of materials in the composite jacket and the amount of density reduction of each layer. That is, with a high density outer layer, the outer layer can be made thinner or the inner layer can accommodate a greater degree of expansion, or both. With both a thinner outer layer and increased expansion for the inner layer, the cable can use less material than what would be required conventionally.

In those embodiments where only the inner circumferential layer 210 is expanded, the foaming characteristics for that layer do not need to consider surface quality. Outer circumferential layer 220 will provide a smooth and glossy exterior finish.

If outer circumferential layer 220 is foamed, however, then surface quality may be a concern. Indeed, in alternate embodiments, the inner and outer jacket layers may both be expanded. Applicants have observed that the drawdown ratio ("DDR") achieved during sleeving extrusion impacts the surface quality of the expanded jacket. The drawdown ratio is defined by the following equation:

$$DDR = \frac{D_2^2 - D_1^2}{d_2^2 - d_1^2}$$

wherein $D_2$ is the die orifice diameter, $D_1$ is the outer diameter of the guiding tip, $d_2$ is the outer diameter of the cable jacket, and $d_1$ is the inner diameter of the cable jacket. The appropriate drawdown ratio for achieving a desired surface finish may be determined experimentally, and will vary based on the polymer used, the nature of the foaming agent, and the amount of the foaming agent. As will be appreciated, an acceptable surface finish depends on the intended application for the cable. Moreover, the acceptability of the surface finish is typically determined by one of ordinary skill in the art, often by touch or visual inspection. Although techniques exist for measuring the surface smoothness of materials, and may be employed to gauge the smoothness of an expanded jacket, those techniques generally are employed for materials where smoothness is so critical that it cannot be determined by visual observation or by touch. Preferably, DDR is comprised from about 0.5 to 2.5.

In other alternate embodiments, the composite jacket may comprise multiple layers of more than two. This configuration would be important for specialized designs when greater resistance to mechanical abuse and/or further improved flexibility are necessary. A third layer may be an intermediate layer 215 between inner circumferential layer 210 and outer circumferential layer 220, as shown in FIG. 2. The choice for a third layer could be any material, typically one that provides an enhanced resistance to mechanical abuse, such as a higher density polyethylene or polypropylene. The amount of expansion for the third layer will naturally depend on the properties selected for the other layers. Given typical constraints in the outer diameter of the cable and the presence of another expanded layer already, the amount of foaming for a third layer will tend to be low, although no restriction exists in this regard for the present invention. For example, a third layer may have a degree of expansion of about 10-12%.

Under the arrangement disclosed herein, the expanded polymeric material of jacket 130 provides cable 100 with reduced weight, increased flexibility, and increased jacket strippability, as explained below. The expanded polymeric material in the jacket also decreases the likelihood that concentric neutral elements will create indentations on the surface of the core, and thus reduce the risk of water migration along the cable should a break occur in the outer jacket.

To illustrate advantageous aspects consistent with the present invention, one conventional cable (Cable 1) and two exemplary cables consistent with the invention (Cable 2 and Cable 3) have been tested and compared to one another. Each cable 100 comprises identical conducting elements 110 of #1/0 AWG 19 wire aluminum, semi-conducting conductor shield, a 175 mil nominal crosslinked polyethylene insulation, 6 #14 AWG helically applied concentric neutral elements. The outer jacket 130 for Cable 1 was a solid 50 mils nominal thickness encapsulated linear low density polyethylene solid jacket. The encapsulated outer jacket 130 for Cable 2 was 50 mils nominal thickness with an expanded linear low density polyethylene inner circumferential layer 210 of 35 mils, and a linear low density polyethylene solid outer circumferential layer 220 of 15 mils. The encapsulated outer jacket 130 for Cable 3 was 50 mils nominal thickness with an expanded linear low density polyethylene inner circumferential layer 210 of 40 mils and high density polyethylene solid outer circumferential layer 220 of 10 mils. The overall jacket thickness requirement was measured as 50 mils above the concentric neutral elements 150 with the jacket also filling the valleys between the elements that are measured at 80.8 mils (#14 AWG wires), using testing parameters in accordance with ICEA/ANSI ICEA S-94-649, an industry standard for concentric neutral cables rated 5 to 46 kV. Table 1 illustrates the general physical properties of each of the exemplary cables described above, such as density reduction, tensile strength, and elongation at break.

TABLE 1

Physical Properties

| Composite Jacket | Density Reduction % of inner layer) | Tensile Strength psi (MPa) 20 in/min | 10 in/min | 2 in/min | Elongation at Break % 20 in/min | 10 in/min | 2 in/min | ICEA Requirement Tensile Minimum | ICEA Requirement Elongation |
|---|---|---|---|---|---|---|---|---|---|
| CABLE 1 | 0 | 2550 (17.6) | 2712 (18.7) | 2890 (19.9) | 690 | 650 | 623 | 1700 psi 11/.7 MPa | 350% |
| CABLE 2 | 23 | 1712 (11.8) | 1915 (13.2) | 1987 (13.7) | 609 | 575 | 645 | 1700 psi 11/.7 MPa | 350% |
| CABLE 3 | 18 | 1508 (10.4) | 1770 (12.2) | 2002 (13.8) | 629 | 573 | 649 | No requirement specified. | |

In addition to general physical cable properties detailed in Table 1, Cable 1, Cable 2, and Cable 3 were subjected to a modified three (3) point bend per a modified ASTM D709 Method 1, to accommodate full scale cable samples as compared to the ASTM specified molded, in order to determine the flexibility of each cable.

In this test, each cable was supported by a two point nine inch span and a one point loading nose for applying the bending load with a deformation speed of two (2) inches per minute. The bending load included of a half circle, three inch radius, mandrel to apply the bending load. The test continued until the cable is wrapped around the mandrel. Each cable was subjected to the bending load, rotated 120 degrees, tested again, then repeated one more time after rotating the cable another 120 degrees.

The data listed in Table 2 represents the average of the three bending loads, applied individually, to five (5) separate cable lengths. When compared to Cable 1, having a solid outer jacket, Cable 2 and Cable 3 had a reduced maximum bending force, the force required to bend the cable 180 degrees around the bending mandrel, of about 12% to 13%.

TABLE 2

Cable Flexural Property

| Cable Item ID | Cable Diameter (inch/cm) | Extruded Jacket | Maximum Bending force (Lbf/N) |
|---|---|---|---|
| CABLE 1 | 1.060 (2.692 cm) | Standard LLDPE | 108.4 (482.2 N) |
| CABLE 2 | 1.058 (2.687 cm) | Foam LLDPE/Solid LLDPE | 96.7 (430.1 N) |
| CABLE 3 | 1.065 (2.705 cm) | Foam LLDPE/Solid HDPE | 95.7 (425.7 N) |

Figure 4:
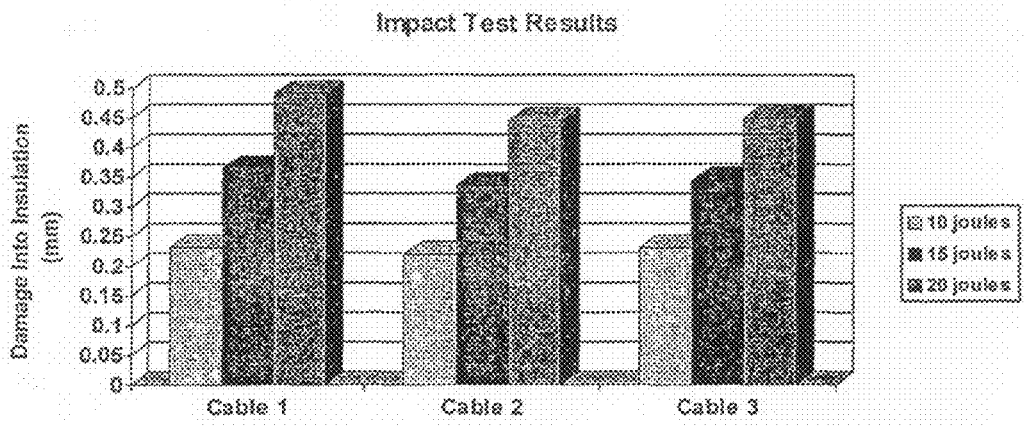
FIG. 4 is a bar chart illustrating the impact resistance between a conventional cable and exemplary cables in accordance with the present invention.

In addition to having a higher degree of flexibility over Cable 1, Cable 2 and Cable 3 are also more resistant to impacts. In particular, the voids introduced into the inner circumferential layer 210 during expansion allow inner circumferential layer 210 of Cable 2 and Cable 3 to absorb energy and thus reduce damage to the cables upon impact. The data shown in Table 3 below, and in FIG. 4 (a graphic representation of the damage and energy data from Table 3) represent the average of two impacts for each of Cables 1, 2, and 3. Density reduction refers to the ratio of the volume of voids per a given volume of polymeric material, and height of weight is distance the impact tool is raised above the cable. Based upon this height, and the actual weight of the impact tool, the force of impact, or energy, is determined. Damage to insulation is the amount of deformation into the core measured from the insulation shield 125. At the higher impact levels, the Cable 2 and Cable 3 exhibited approximately 10% less deformation of the insulated core as compared to Cable 1.

TABLE 3

Impact Test Results

| Cable Item ID | Cable Diameter (mm) | Density Reduction of Inner Layer | Height of Weight (mm) | Energy (Joule) | Damage into Insulation Average (mm) |
|---|---|---|---|---|---|
| Cable 1 | 27 | 0 | 78.4 | 10 | 0.23 |
| | | | 117.6 | 15 | 0.37 |
| | | | 156.9 | 20 | 0.49 |
| Cable 2 | 27 | 23% | 78.4 | 10 | 0.22 |
| | | | 117.6 | 15 | 0.33 |
| | | | 156.9 | 20 | 0.44 |

TABLE 3-continued

| Impact Test Results | | | | | |
|---|---|---|---|---|---|
| Cable Item ID | Cable Diameter (mm) | Density Reduction of Inner Layer | Height of Weight (mm) | Energy (Joule) | Damage into Insulation Average (mm) |
| Cable 3 | 27 | 18% | 78.4 | 10 | 0.23 |
| | | | 117.6 | 15 | 0.32 |
| | | | 156.9 | 20 | 0.46 |

The impact tests were conducted employing an impact testing device similar to that specified in the French Specification HN 33-S-52, clause 5.3.2.1. The impact testing machine was modified to run impact energies up to 350 Joule (the French specification defines 72 Joule only), and an equivalent impact tester shape (90 degree wedge shaped impactor, 2 mm radius on tip/edge). During the test, the wedge shaped impacted each cable with the energy noted above. After each single impact, the total thicknesses of the various layers and the local damage on the insulation 120, with an optical laser system, measured the damage depth.

A further physical aspect of a power cable 100 is the strippability of the outer jacket 130. Strippability corresponds to the amount of pulling force required to remove the outer jacket 130 during splicing or terminating the cable 100. Removal of the outer jacket 130 is commonly accomplished by retrieving one of the concentric neutral elements 150 encapsulated by the outer jacket 130, and pulling it through the outer jacket 130, thereby cutting the outer jacket 130 along the spiral axis of the cable 100. The concentric neutral wire 150 is lifted and pulled at about a 15° angle to the longitudinal axis of the cable 100. If a significant amount of force is required to remove the outer jacket 130 from the cable 100, it is more time consuming to strip the cable and there is an increased likelihood that the insulation shield 125 and/or insulation 120 may be damaged. It is therefore preferable to minimize the amount of pulling force-necessary to remove the outer jacket 130 from the cable 100. In order to compare the pulling force required to remove the outer jacket 130 between a conventional cable (Cable 1) and the exemplary cables (Cable 2 and Cable 3), a test was performed on each cable 100 to record the amount of pulling force required for each cable 100.

Prior to performing the test, the outer jacket 130 thickness was measured at a single randomly chosen cross section for each cable sample. The measurement was taken with SPSS Sigma Scan software using microscopic photographs from an Olympus SZ-PT Optical Microscope coupled to a Sony 3CCD color video camera. Further, confirmation measurements were taken with a Nikon V-12 Profile Projector coupled to a Nikon SC-112 counter. The average of the measurements, rounded to the nearest mil, was used to normalize the concentric neutral wire 150 pull out force.

The test involved measuring the force required to pull a concentric neutral wire 150 through outer jacket 130 at a pull speed of 20 inches/minute at an angle of 15° from the outer jacket 130. Each pull duration equaled the concentric neutral wire 150 lay length, and two pulls (concentric neutral elements 1800 apart) per sample length were completed. A total of 10 pulls were completed for Cable 1 and 6 pulls were completed for Cable 2 and Cable 3.

The test data, as shown in Table 4 below, shows that expansion of the inner circumferential layer 210 of the outer jacket 130 reduces the amount of force required to remove a concentric neutral wire 150 from the outer jacket 130. The data shows that the concentric neutral wire 150 pull out force is less for both of the exemplary cables consistent with the principles of the present invention. As the actual outer jacket 130 thickness did vary slightly as measured along each cable, a normalized outer jacket thickness was determined for each. The concentric neutral wire 150 pullout force was approximately 20% less for exemplary Cable 2 and 15% less for exemplary Cable 3, in comparison to the pullout force required for Cable 1. The rise in pullout force from Cable 2 to Cable 3 can be attributed to the lower foaming level of the inner circumferential layer 210 and the higher density polyethylene outer circumferential layer 220 of Cable 3. Further reductions in pullout force can be foreseen when the outer circumferential layer 220 is also expanded in addition to the inner circumferential layer 210.

TABLE 4

| Filament Pullout Force Data | | | |
|---|---|---|---|
| | Cable 1 | Cable 2 | Cable 3 |
| Second Layer Polymer | LLDPE | LLDPE | HDPE |
| First Layer Polymer | LLDPE | Expanded LLDPE | Foamed LLDPE |
| First Layer Foaming, % | 0 | 23 | 18 |
| Filament Pull Force | | | |
| Min Avg, pounds | 36.1 | 32.3 | 30.3 |
| Max Avg, pounds | 49.9 | 42.0 | 41.1 |
| Average, pounds | 41.5 | 37.4 | 36.0 |
| Normalized Avg/Jacket Thickness, pounds/inch | 703 | 566 | 600 |

In addition to minimizing the concentric neutral wire 150 pullout force required to strip the outer jacket 130 from a cable 100, the degree of indentations that may be introduced from concentric neutral elements 150 upon the surface of the insulation shield 125, and potentially on the insulation 120, is desirably reduced. It is desirable to minimize such indentations since they can provide pathways for water to longitudinally migrate along the length of the cable 100 should water enter cable 100 due to a breach in the outer jacket 130.

To compare the ability of each cable to minimize the degree of concentric neutral wire 150 indentation upon the surface of the insulation shield 125 and the insulation 120, the standardized test ICEA/ANSI S-94-649 was performed on a conventional cable (Cable 4) and a single exemplary cable (Cable 5). Specifically, both cables contained identical conducting elements 110 of #2 AWG 7 wire aluminum, a semi-conducting conductor shield, 175 mils nominal EPR (ethylene propylene rubber) insulation, and six #14 AWG helically applied copper concentric neutral elements 150. Further, the Cable 4 had a 50 mils nominal thickness encapsulated LLDPE solid outer jacket 130 while the outer jacket 130 of Cable 5 has a 50 mils nominal thickness encapsulated LLDPE expanded inner circumferential layer 210 of 35 mils and a LLDPE solid outer circumferential layer 220 of 15 mils for its outer jacket 130.

Measurements of concentric neutral wire 150 indentation into the insulation shield 125 were taken and recorded in accordance with ICEA/ANSI S-94-649. The data of Table 5 below clearly exhibits a 50% reduction in the degree of indentation for Cable 5, as compared to Cable 4. This greatly reduces a helical water migration path should the overall jacket be subjected to breach or damage.

TABLE 5

| Concentric Neutral Indent Data | | |
|---|---|---|
| | Cable 4 | Cable 5 |
| Outer Layer Polymer | LLDPE | LLDPE |
| Inner Layer Polymer | LLDPE | Expanded LLDPE |
| Inner Layer Foaming, % | 0 | 19 |
| Concentric Neutral Wire Indent (mils) | | |
| Minimum | 3.2 | 0.0 |
| Maximum | 10.3 | 4.5 |
| Total Average | 5.9 | 2.3 |

Figure 5:
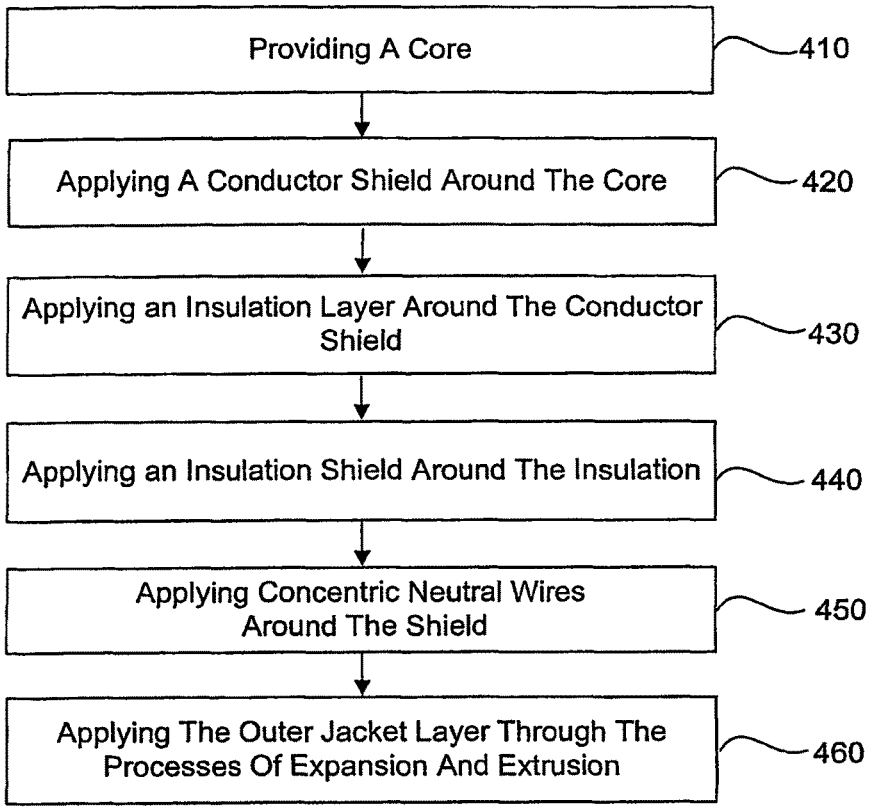
FIG. 5 is a process flow diagram of a method of manufacturing a cable in accordance with the present invention.

FIG. 5 is a high-level process flow diagram of a method of manufacturing a cable 100 in accordance with the principles of the present invention. A core, comprising conducting elements 110, is provided 410 and a conductor shield 115 is applied around the core 420. Further, an insulation 120 is applied 430 and an insulation shield 125 is applied 440 around the insulation 120. Next, concentric neutral elements 150 are applied around the insulation shield 450. Finally, the outer jacket 130 is applied through the processes of expansion and extrusion 460.

In more detail, a core of the cable 100 is obtained by helically winding metallic conductive elements into a circular electrical conductor. Each strand has a pre-determined diameter; and each layer of strands are helically applied with a pre-determined length of lay of the elements to achieve a specified overall diameter and minimum circular mil area. Each conductor has a layer comprising the conductor shield, insulation and insulation shield, normally applied by extrusion. At the end of the extrusion step, the material of each layer is preferably cross-linked in accordance with known techniques, for example by using peroxides or silanes. Alternatively, the material of the insulation layer can be of the thermoplastic type that is not cross-linked, so as to ensure that the material is recyclable. Once completed, each core is stored on a first collection spool.

The material for the conductor shield 115 and insulation layers 120/125 is expanded and extruded over the conducting elements 110. The polymeric composition of these layers can incorporate a pre-mixing step of the polymeric base with other components (fillers, additives, or others), the pre-mixing step being performed in equipment upstream from the extrusion process (e.g., an internal mixer of the tangential rotor type (Banbury) or with interpenetrating rotors, or in a continuous mixer of the Ko-Kneader (Buss) type or of the type having two co-rotating or counter-rotating screws). Pre-mixing of compounds may be conducted either at the cable manufacturer's facilities or by a commercial compounder.

Each polymeric composition is generally delivered to the extruder in the form of granules and plasticized (i.e., converted into the molten state) through the input of heat (via the extruder barrel) and the mechanical action of a screw, which works the polymeric material and delivers it to the extruder crosshead where it is applied to the underlying core. The barrel is often divided into several sections, known as "zones," each of which has an independent temperature control. The zones farther from the extrusion die (i.e., the output end of the extruder) typically are set to a lower temperature than those that are closer to the extrusion die. Thus, as the material moves through the extruder it is subjected to gradually greater temperatures as it reaches the extrusion die. The expansion of the conductor shield 115 and insulation layers 120/125 (and optionally the filler material, if any is used) is performed during the extrusion operation using the products and parameters discussed above.

The application of the outer jacket 130 to the cable 100 as illustrated in FIGS. 2 & 3 can be applied in several manners. In one process the inner circumferential layer 210 and outer circumferential layer 220 are applied to the cable 100 in two separate extrusion processes. These two extrusion processes can be performed in totally separate operations or can be tandemized in a single operation where the two extrusions are separated by an adequate distance to enable cooling of the first layer before application of the second extruded layer. In an alternative process, the two layers 210/220 can be extruded simultaneously in the same extrusion crosshead using a co-extrusion process. In such a process two extruders are used to each supply one of the layers (foamed or non-foamed) to a single extrusion crosshead.

Two types of co-extrusion process can be employed to achieve the layers 210/220 of the outer jacket 130. In one process the two layers 210/220 are maintained in separate channels until the point at which both layers 210/220 are applied to the cable 100. In such a process the double layer extrusion head comprises a male die (or tip), an intermediate die (or tip-die), and a female die. The dies are arranged in the sequence just discussed, concentrically overlapping each other and radially extending from the axis of the assembled element. The inner circumferential layer 210 is extruded in a position radially external to the outer circumferential layer 220 through a conduit located between the intermediate die and the female die. The inner circumferential layer 210 and outer circumferential layer 220 merge together simultaneously at the point of application to the cable 100. In an alternative co-extrusion process, the inner circumferential layer 210 and outer circumferential layer 220 are merged together in concentric layers within the extrusion crosshead. In such a process the crosshead comprises a male die (or tip) and a female die. No intermediate die is employed. The combined layers of the inner circumferential layer 210 and outer circumferential layer 220 flow through a conduit between the male and female dies and are applied simultaneously to the cable 100.

The semi-finished cable assembly thus obtained is generally subjected to a cooling cycle. The cooling is preferably achieved by moving the semi-finished cable assembly in a cooling trough containing a suitable fluid, typically well water/river water or closed loop cooling water system. The temperature of the water can be between about 2° C. and 30° C., but preferably is maintained between about 10° C. and 20° C. During extrusion and to some extent during cooling, the jacket layers 210 and 220 collapse to substantially take the shape of the periphery of the assembled element. Downstream from the cooling cycle, the assembly is generally subjected to drying, for example by means of air blowers, and is collected on a third collecting spool. The finished cable is wound onto a final collecting spool.

Those of ordinary skill in the art will recognize that several variations of this process can be used to obtain a cable consistent with the principles of the invention. For example, several stages of the process may be performed in parallel at the same time. These known variations are to be considered within the scope of the principles of the invention.

While preferred embodiments of the invention have been described and illustrated above, it should be understood that these are exemplary of the invention and are not to be considered as limiting. For example, although a power cable consistent with the present invention is particularly suited for applications throughout the electrical utility industry including residential underground distribution (URD), or primary underground distribution, and feeder cables, the cable design described herein may be applied to other sizes and capacities of cables without departing from the scope of the invention. Additions, omissions, substitutions, and other modifications can be made without departing from the spirit or scope of the present invention. Accordingly, the invention is not to be considered as being limited by the foregoing description, and is only limited by the scope of the appended claims.

We claim:

1. An electrical cable for underground installation comprising:

a core forming the interior of the cable with an outer periphery defined by an insulation shield;

a plurality of neutral elements arranged circumferentially around a radius and helically along a length of the cable, the neutral elements electrically contacting the insulation shield of the core; and a composite outer jacket surrounding the core and forming the exterior of the cable, the composite outer jacket including an inner circumferential layer proximate to the core and an outer circumferential layer, the inner circumferential layer substantially encapsulating the plurality of neutral elements, at least the inner circumferential layer being an expanded polymeric material, the inner circumferential layer providing cushioning against impact damage to the cable during installation, providing cushioning against formation of indentations in the insulation shield from the neutral elements, and permitting stripping of the jacket using one or more of the neutral elements, wherein the outer circumferential layer has a degree of expansion of about 2-50%.

2. The cable of claim 1, wherein the core comprises a conductor, a conductor shield surrounding the conductor, an insulation surrounding the conductor shield, and the insulation shield surrounding the insulation.

3. The cable of claim 2, wherein the insulation shield is a semi-conducting or non-conducting material.

4. The cable of claim 3, wherein the plurality of concentric neutral elements are wires ranging in size from #24 AWG to #8 AWG.

5. The cable of claim 3, wherein the total circular mil area of the plurality of the neutral elements is between about 5000 circular mils per inch of insulated core diameter to the full total circular mil area of the phase conductor.

6. The cable of claim 1, wherein the inner circumferential layer has a degree of expansion of about 2-50%.

7. The cable of claim 6, wherein the outer circumferential layer comprises about 20-30% of a radial thickness of the outer jacket, and the inner circumferential layer and the outer circumferential layer comprise linear low density polyethylene (LLDPE).

8. The cable of claim 7, wherein the inner circumferential layer has a degree of expansion of up to about 15-25%.

9. The cable of claim 6, wherein the outer circumferential layer comprises high density polyethylene (HDPE) and comprises about 20% of a radial thickness of the outer jacket, and the inner circumferential layer comprises LLDPE.

10. The cable of claim 9, wherein the inner circumferential layer has a degree of expansion of up to about 30%.

11. The cable of claim 1, wherein the outer jacket further comprises an intermediate circumferential layer of polymeric material.

12. The cable of claim 11, wherein the intermediate circumferential layer has a degree of expansion of about 10-12%.

13. The cable of claim 1, wherein the outer jacket comprises at least one material selected from the group consisting of polyvinyl chlorides (PVC), ethylene vinyl acetates (EVA), low density polyethylene, LLDPE, HDPE, polypropylene, and chlorinated polyethylene.

14. A method of making a cable comprising:

providing a conductor;

applying a shield around the conductor;

extruding insulation over the shield;

applying an insulation shield over the insulation;

applying concentric neutral elements around and in contact with the insulation shield;

expanding a polymeric material with a foaming agent; and extruding an inner circumferential layer of the expanded polymeric material and extruding an outer circumferential layer to form an outer jacket and to substantially encapsulate the concentric neutral elements while maintaining contact between the concentric neutral elements and the insulation shield, the inner circumferential layer providing cushioning against impact damage to the cable during installation, providing cushioning against formation of indentations in the insulation shield from the neutral elements, and permitting stripping of the jacket using one or more of the neutral elements, wherein the outer circumferential layer of polymeric material has a degree of expansion of about 2-50%.

15. The method of claim 14, wherein extruding the inner circumferential layer and the outer circumferential layer are separate operations.

16. The method of claim 14, wherein extruding the inner circumferential layer and the outer circumferential layer is a tandemized operation.

17. The method of claim 14, wherein extruding the inner circumferential layer and the outer circumferential layer is accomplished by co-extrusion.

18. The method of claim 14, wherein extruding further comprises extruding an intermediate circumferential layer of polymeric material.

19. The method of claim 18, further comprising expanding the intermediate circumferential layer in the range of about 10% to 12%.

20. The method of claim 14, wherein expanding includes applying a foaming agent to a polymeric material.

21. The method of claim 14, wherein expanding comprises decreasing the density through foaming of the inner circumferential layer in the range of about 2% to 50%.

22. An electrical cable for underground installation comprising:

a core forming the interior of the cable with an outer periphery defined by an insulation shield;

a plurality of neutral elements arranged circumferentially around a radius and helically along a length of the cable, the neutral elements electrically contacting the insulation shield of the core; and a composite outer jacket surrounding the core and forming the exterior of the cable, the composite outer jacket including an inner circumferential layer proximate to the core and an outer circumferential layer, the inner circumferential layer substantially encapsulating the plurality of neutral elements, the inner circumferential layer and the outer circumferential layer each being an expanded polymeric material and having a degree of expansion in the range of about 2% to 50%.

23. A method of making a cable comprising:

providing a conductor;

applying a shield around the conductor;

extruding insulation over the shield;

applying an insulation shield over the insulation;

applying concentric neutral elements around and in contact with the insulation shield;

expanding a polymeric material with a foaming agent; and extruding an inner circumferential layer of the expanded polymeric material and extruding an outer circumferential layer to form an outer jacket and to substantially encapsulate the concentric neutral elements while maintaining contact between the concentric neutral elements and the insulation shield, the inner circumferential layer and the outer circumferential layer each having a degree of expansion in the range of about 2% to 50%.

* * * * *